United States Patent [19]

Cho

[11] 4,162,806

[45] Jul. 31, 1979

[54] SAFETY FOLDING CHAIR

[76] Inventor: Yush-Chye Cho, 2320 Glenmore Ter., Rockville, Md. 20850

[21] Appl. No.: 861,122

[22] Filed: Dec. 16, 1977

[51] Int. Cl.[2] ..... A47C 4/00

[52] U.S. Cl. ..... 297/19; 297/58

[58] Field of Search ..... 297/19, 24, 58, 21, 297/55, 313; 248/188.2

[56] References Cited

U.S. PATENT DOCUMENTS

| | | | |
|---|---|---|---|
| 188,969 | 3/1877 | Smith | 297/21 |
| 514,445 | 2/1894 | Cornell | 297/24 |
| 1,562,226 | 11/1925 | Glantz | 297/58 |
| 2,294,340 | 8/1942 | Mains | 297/58 |
| 2,381,574 | 8/1945 | Clarin | 297/58 |
| 3,520,506 | 7/1970 | Szohatzky | 248/188.2 X |

*Primary Examiner*—Roy D. Frazier
*Assistant Examiner*—Peter A. Aschenbrenner
*Attorney, Agent, or Firm*—Robert D. Farkas

[57] ABSTRACT

A safety folding chair utilizes an elongated metallic plate secured at selected positions along the length of the rearmost legs having an inclined elongated slot therein with a down turned hook like end. A pin is secured extending outwardly from the rearmost marginal edge of the side wall of the seat and engages the slot. When the pin is engaged in the hook like end of the slot the rear leg cannot be inadvertently pivoted inwardly due to a force applied at the lowermost regions thereof, thereby securing the chair in an erected position providing safety to a user thereof.

5 Claims, 3 Drawing Figures

SAFETY FOLDING CHAIR

BACKGROUND OF THE INVENTION

1. The Field of the Invention

This invention relates to folding chairs, and more particularly to that class having an elongated pin engaging slot therein.

2. Description of the Prior Art

The prior art abounds with folding chairs. United States Patent, bearing Ser. No. 2,555,113 issued May 29, 1951 and United States Patent bearing Ser. No. 2,568,269 issued Sept. 18, 1951, to H. C. Burnham, in part, both teach folding chairs having toggle like elements engaging the uppermost region of the rear leg rails to the rear inclined surfaces of the front leg rails. The Burnham devices maybe easily collapsed accidently upon applying an upward force to the uppermost regions of the front legs so as to cause the toggles to reverse position, permitting the folding chair to have the lowermost regions of the rearmost legs move towards the lowermost regions of the front legs, thereby spilling an occupant thereof onto the ground. U.S. Pat. Nos. 947,090 issued Jan. 18, 1910 to J. J. Wolfe and 1,493,060 issued May 6, 1924 to M. F. Bayer and 2,649,141 issued Aug. 18, 1953 to G. B. Marshall et al all teach folding or collapsable furniture employing the metallic plates or other elongated elements in which pin like members are installed in elongated slots therein having a generally straight nature. The pins are free to move along the length of the slot thereby permitting various folding elements comprising the folding chair to pivot relative to one another from an erected opened condition into a folded flat condition. Small forces applied generally to the rearmost lowermost regions of the legs, generally cause such pins to move along the length of the slot, at which time an erected chair will accidently fold up into a collapsed state such that the four point contact locations defined by the lowermost regions of the legs approximate one another so as to reside substantially along the straight line thereby minimizing the stable characteristics of an otherwise erected and untouched chair. Such chairs are totally unsatisfactory when being utilized by children or those uneducated in their safe use. Previous attempts to utilize such chairs resulted in designs which necessitated difficult to move pivotlly related components so as to minimize the possibility of accidental dislodgement of the leg elements from a preferred angular relationship to substantially parallel relationship, thereby limiting the use of such folding furniture by the elderly or the infirm.

SUMMARY OF THE INVENTION

A primary object of the present invention is to provide a folding chair which is totally safe for use by children.

Another object of the present invention is to provide a folding chair possessing a minimum number of moving parts.

Still another object of the present invention is to provide a folding chair which maybe easily translated from an opened erected condition to a closed folded up storage condition.

Yet another object of the present invention is to provide a folding chair which has the seat portion thereof adjustable relative to the angular inclination assumed thereby, when in an opened condition, relative to a supporting surface.

A further object of the present invention is to provide a folding chair whose slideable parts, disposed in touching engagement with one another, are all metallic, thereby enhancing the life of such chair despite heavy use.

Another object of the present invention is to provide a folding chair which maybe easily assembled, economical to construct, durable in construction and otherwise particularly suited for the objects thereof.

Heretofore, folding chairs having front and rear leg elements, a seat element and a back element were fabricated such that the lowermost regions of the front and rear legs maybe disposed adjacent one another when the seat element was moved out of a horizontal plane so as to collapse into a flat-like object where in the seat and the front and rear leg portions substantially resided parallel to one another, having the backrest portion disposed in a plane substantially parallel to the plane of the seat when such seat is in a folded-up condition. Removable pins, elongated linear slots, toggle bars and alike all play their part in prior art construction. All such devices suffered the same general deficiency of being relatively unstable when an applied force was directed to the rearmost regions of rearmost legs in the direction of the lowermost region of the front legs. As many as four sliding members were utilized to produce such unsafe folding chairs, sometimes referred to as collapsable chairs.

Present invention recognizes this deficiency and not only provides a solution therefor but provides a chair having a minimum number of relatively slideable parts and, thus, provides a chair of economical construction and enhanced durability. A sequential unlocking motion is required so as to permit the present invention to be disposed in a folded up condition, thus enhancing the safety characteristics of the present invention when being utilized by children or other unknowing individuals. The propensity of the prior art chair to collapse when being dragged about on a supporting surface when in an opened condition is thus eliminated. Because the present invention utilizes a design which is totally safe in use, loosely engaging slideable parts and elements that are adapted to pivot relative to one another easily maybe employed.

These objects as well as other objects of the present invention, will become more readily apparent after reading the following description of the accompanying drawings.

DESCRIPTION OF THE PREFERRED EMBODIMENT

Figure 1:
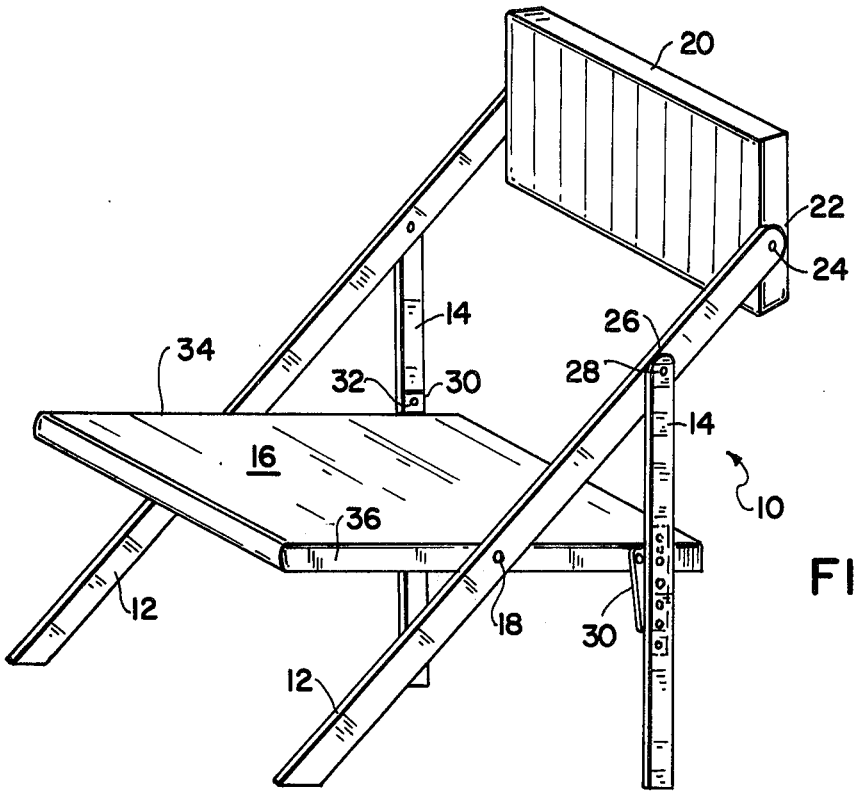
FIG. 1 is a perspective view of the present invention.

The structure and method of fabrication of the present invention is applicable to a folding chair having a pair of elongated straight bars forming the front legs and similar shaped bars forming the rear legs, a planar seat having parallel side marginal edges, disposed and spaced apart in relationship, a backrest portion and a pair of metallic plates and a pair of pins. The front leg bars are pivotably secured to the side marginal edges of the seat in an area adjacent the lowermost regions thereof. The uppermost ends of the front leg bars carry a backrest portion pivotably secured thereto. The rear leg elements, comprising the bars aforementioned having a shorter length leg than the front leg bars are pivotably secured to such front length leg bars at the uppermost regions thereof, intermediate the pivotal attachment of the seat portion and backrest portion. Here, the similarity with other folding chairs well known in the prior art ceases. The pair of metallic-like plates are secured to the opposed lateral surfaces of the rear leg bars intermediate the location of the side walls of the seats, utilizing a pair of pins disposed in two holes of a plurality of spaced apart holes located along the length of the metallic plates. A pair of pins have one end thereof secured to the seat portion and have the other end thereof residing in an elongated substantially vertically disposed slot in the metallic plates. The free ends of one pin capped with a flat disc like portion, similar to a rivet. The uppermost region of the slot is provided having a downwardly turned hook-like end of sufficient width to accommpany therein a portion of the length of the pin adjacent the cap portion thereof.

In use, the chair is erected in normal fashion, by applying a downward force on the frontmost region of the seat portion whilst permitting the lowermost regions of the rear legs to move outwardly from the lowermost region of the front legs. During this operation, a pin moves upwardly along the length of the slots so as to permit the seat to reside in a near horizontal position. When the pair of pins, each disposed in opposed metal-like plates, engage and lock in the hook-like ends of the slots, the rear legs are locked into position. Forces applied to the lowermost regions of rear legs or on the rearmost region of the seat portion will not dislodge the pins from engagement within the hook-like ends of the slots. When it is desired to fold the chair up, a rapid alternating force, applied to the frontmost edge of the chair seat causes the pins to disengage the hook-like end of the slot and reside in the uppermost region of the straight portion of the slot. Folding operation continues by continuing to apply an upward force on the frontmost region of the seat whilst allowing the lowermost region of the rear legs to move toward the lowermost region of the front legs. Screws may be utilized to maintain the metallic plates at any preferred location along the length of the rear legs by passing through pairs of holes disposed therewithin in spaced apart relationship, thereby permitting the seat portion to reside at any preferred angle relative to the supporting surface, utilized in supporting the lowermost ends of the front legs, and the rear legs thereof.

Now referring to the figures, and more particularly to the embodiment illustrated in FIG. 1 showing the present invention 10 having front legs 12 and rear legs 14. Seat portion 16 is shown pivotably secured to front legs 12, utilizing pivot axle 18 therefor. Backrest portion 20 is pivoted to end 22 of front leg portion utilizing axle 24 therefor. Uppermost end 26 of rear leg 14 is pivotably secured to front leg 12, utilizing axle 28 therefor. Metallic plates 30 are shown carried by rear legs 14 and utilized screw 32 for mounting plate 30 to leg 14. Plates 30 are shown secured on opposed marginal edges 34 and 36 of seat 16, such edges carrying axle 18.

Figure 2:
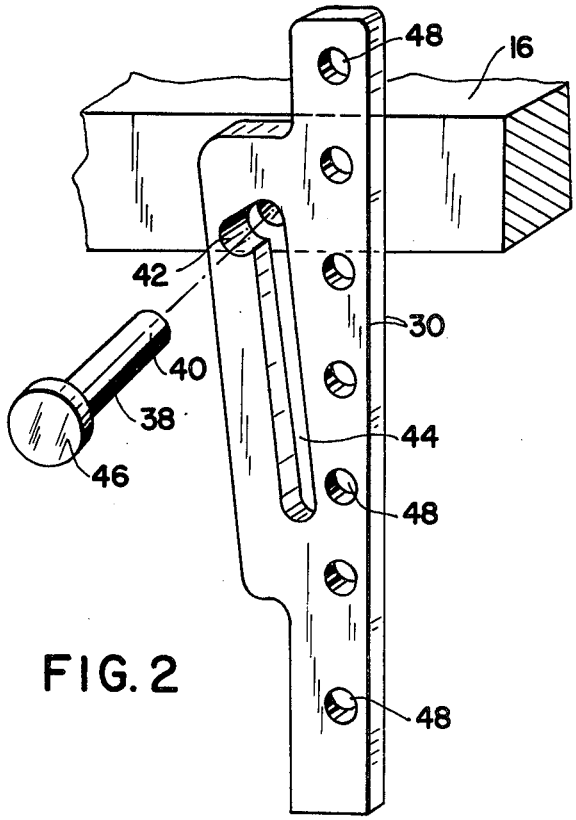
FIG. 2 is a perspective, exploded view of a portion of the apparatus shown in FIG. 1.

FIG. 2 illustrates seat portion 16 having metallic plate 30 disposed adjacent thereto rivet like pin 38 is shown having end 40 thereof adjacent hook like end 42 of elongated slot 44. Rivet 38 is provided with a cap like element 46, and an end opposite end 46. Holes 48 are shown carried by metallic plate 30 in spaced apart relationship.

Figure 3:
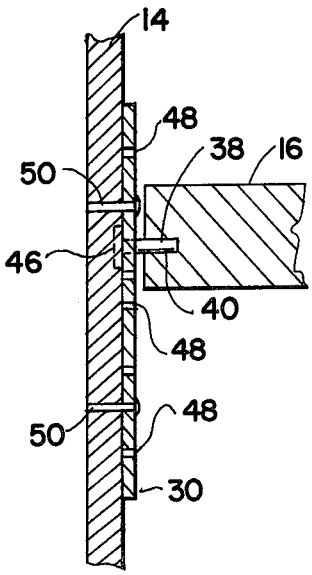
FIG. 3 is a side elevation cross sectional view, taken in the direction of arrows 3—3, viewed along line 3—3, of the apparatus shown in FIG. 1.

FIG. 3 illustrates a portion of seat 16 having end 40 of rivet like pin 38 installed therein. Cap like end 46 is shown disposed behind the rearmost surface, not shown, of rear leg element 14. Screws 50 are shown passing through two holes 48 so as to engage metallic plate 30 at a preferred location along the length of rear leg 14.

It should be noted that downwardly turned hook like end 42, shown in FIG. 2 extends forwardly from the uppermost end of vertically inclined slot 44. The straight portions of slot 44 are tipped forward, such that hook like end 42 is closet to the frontmost bottom most portions of legs 12, shown in FIG. 1, then the lowermost regions of the straight portion of slot 44. FIG. 3 is particularly useful in recognizing that screws 50 shown therein are equivalent to screw 32, shown in FIG. 1, serving the same function. Screws, pins, or other fastening devices maybe utilized at the will of the user for elements 32 and 50, shown in FIGS. 1 and 3 respectively. If desired, rivet like pin 38, shown in expanded form in FIG. 2, may be formed in the shape of a elongated rod, passing through a hole, not shown, extending transverse side walls of seat 16, shown in FIG. 1 so as to pass outwardly from the metallic plate element pairs 30, shown in FIG. 1. The novelty of the present invention resides in the hook like end of the elongated inclined slot fashioned in the metallic plates 30 which are located along the length of the rear legs 14 engaging selectively a pair of pins or a common rod, being secured to the side opposed walls of the seat element. The metallic plate maybe fabricated from a plated steel, similar to the construction of the rivet like pins 38. All other elements of the present invention maybe fabricated from wood or other rigid materials, excepting the pivot axles 18, 28 and 24. Such axles maybe fabricated from any suitable rigid metal-like material.

One of the advantages of the present invention is a folding chair which is totally safe for use by children.

Another advantage of the present invention is a folding chair possessing a minimum number of moving parts.

Still another advantage of the present invention is a folding chair which maybe easily translated from an open erected condition to a closed folded up storage condition.

Yet another advantage of the present invention is a folding chair which has the seat portion thereof adjustable relative to the angular inclination assumed thereby, when in an opened condition, relative to a supporting surface.

A further advantage of the present invention is a folding chair whose slideable parts, disposed in touching engagement with one another, are all metallic, thereby enhancing the life of such chair despite heavy use.

Another advantage of the present invention is a folding chair which may be easily assembled, economical to construct, durable in construction, and otherwise particularly suited for the objects thereof.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A safety folding chair comprises a seat portion having a pair of opposed marginal side walls, a pair of front leg portions pivotably secured to said side walls, a pair of rear leg portions pivotably secured to said front leg portions adjacent the uppermost ends thereof, a pair of plates, said pair of plates secured to said rear leg portions intermediate said walls and said rear leg portions, said pair of plates having an elongated slot therein, the uppermost region of said elongated slot having a hook-like down turned shape, a pair of pins, one end of said pair of pins fixedly secured to said side walls, the other end of said pair of pins disposed passing through said slots, means to selectively position said seat portion relative to a plane defined by the lowermost regions of said front leg portions and said rear leg portions when said lowermost regions are disposed in spaced apart relationship from one another, said means to selectively position including a pair of fasteners and a plurality of holes being located in said pair of plates, said plurality of holes being disposed in spaced apart relationship, said plurality of holes extending along the length of said rear leg portions, said pair of fasteners passing through a pair of said plurality of holes and removably secured to each of said pair of rear leg portions.

2. The apparatus as claimed in claim 1 wherein said pair of pins comprise a rivet like shape.

3. The apparatus as claimed in claim 1 wherein said pair of plates comprise steel.

4. The apparatus as claimed in claim 1 wherein said pair of rod-like elements comprise steel.

5. The apparatus as claimed in claim 1 wherein said elongated slot is disposed having a straight portion, the uppermost end of said straight portion being disposed adjacent to said hook like portion of said slot, said uppermost end of said straight portion being disposed a greater distance from the longitudinal access of said pair of rear leg elements then the lowermost region of said straight portion of said slot.

* * * * *